US008366596B2

(12) United States Patent
Hayashi

(10) Patent No.: US 8,366,596 B2
(45) Date of Patent: Feb. 5, 2013

(54) SHEET FOLDING DEVICE AND IMAGE FORMING APPARATUS

(75) Inventor: Kakeru Hayashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 12/662,217

(22) Filed: Apr. 6, 2010

(65) Prior Publication Data

US 2010/0284720 A1 Nov. 11, 2010

(30) Foreign Application Priority Data

May 11, 2009 (JP) ..... 2009-114591
Feb. 16, 2010 (JP) ..... 2010-031396

(51) Int. Cl.
*B31B 1/26* (2006.01)

(52) U.S. Cl. ..... 493/405; 493/406; 493/435; 493/442

(58) Field of Classification Search ..... 493/405, 493/406, 416, 434, 435, 442
See application file for complete search history.

(56) References Cited

U.S. PATENT DOCUMENTS

| | | | | | |
|---|---|---|---|---|---|
| 3,576,051 | A * | 4/1971 | Click et al. | ..... | 425/72.1 |
| 5,152,737 | A * | 10/1992 | Wu et al. | ..... | 493/352 |
| 5,190,514 | A * | 3/1993 | Galvanauskas | ..... | 493/420 |
| 5,980,444 | A * | 11/1999 | Dickhoff | ..... | 493/433 |
| 6,602,176 | B1 * | 8/2003 | Ganneval | ..... | 493/405 |
| 7,726,638 | B2 * | 6/2010 | Itagaki | ..... | 270/32 |
| 2009/0062100 | A1 * | 3/2009 | Takekawa et al. | ..... | 493/454 |
| 2009/0129840 | A1 | 5/2009 | Takekawa et al. | | |

FOREIGN PATENT DOCUMENTS

| | | |
|---|---|---|
| JP | 2001-019270 | 1/2001 |
| JP | 2007-045531 | 2/2007 |

* cited by examiner

*Primary Examiner* — Thanh Truong
(74) *Attorney, Agent, or Firm* — Harness, Dickey & Pierce, P.L.C.

(57) ABSTRACT

A sheet folding device includes a folding unit that applies a fold to a sheet, and a fold-enhancing unit that performs fold enhancement on the sheet applied with the fold by the folding unit. The fold-enhancing unit includes at least two or more rotator pairs each provided with a sheet holding member that holds and pressurizes the sheet applied with the fold so as to enhance the hold. In the at least two or more rotator pairs, the sheet holding member is provided so that an area for holding the sheet shifts from both sides of the sheet toward a central portion of the sheet along a sheet conveying direction from an upstream to a downstream in the fold-enhancing unit.

12 Claims, 9 Drawing Sheets

SHEET FOLDING DEVICE AND IMAGE FORMING APPARATUS

CROSS-REFERENCE TO RELATED APPLICATIONS

The present application claims priority to and incorporates by reference the entire contents of Japanese Patent Application No. 2009-114591 filed in Japan on May 11, 2009 and Japanese Patent Application No. 2010-031396 filed in Japan on Feb. 16, 2010.

BACKGROUND OF THE INVENTION

1. Field of the Invention

The present invention relates to a sheet folding device for folding a sheet ejected from an image forming apparatus such as a copier and a printing machine and an image forming apparatus provided with the sheet folding device, and an image forming apparatus provided with the sheet folding device.

2. Description of the Related Art

When a desired fold line is to be formed on a sheet with a fold applied by a folding roller so as not to lose productivity, it is general to cause the sheet with a folded portion to pass through a nip portion between fold-enhancing rollers to enhance the fold. However, if the nip portion between the fold-enhancing rollers is to be pressurized in order to form the desired fold line on the sheet, because of a mechanism in which the pressure is applied to both sides of a shaft of the roller, there arises a problem that the mechanism causes a deviation in a pressure distribution. Moreover, due to unevenness in a shape of a leading edge of the sheet including the folded portion, there occurs a phase difference in the way to cause the sheet to enter the nip portion of the fold-enhancing roller. Therefore, there occurs a problem that undesired deflection occurs in the sheet and the fold is enhanced in that state, to cause wrinkles in the sheet. Thus, a fold-enhancing mechanism is needed to form a desired fold line on the sheet applied with the fold, not to cause undesired deflection as a factor of wrinkles, or to correct the deflection.

To solve the problems, there is disclosed a technology for a pair of folding rollers that is provided with a nip portion formed over a whole width along an outer periphery of at least one of the rollers and also provided with a cutout-formed portion in which only a central portion of the other roller is formed as a nip portion and the other portions thereof are formed as cutout portions. In the pair of folding rollers, a fold is applied to a sheet in the nip portion as the former portion and a deflection is released while the sheet is conveyed by the cutout-formed portion as the latter portion (e.g., Japanese Patent Application Laid-open No. 2001-019270).

However, the technology described in Japanese Patent Application Laid-open No. 2001-019270 has a problem as follows. Because the nip portion to apply the fold thereto is formed over the whole width, a pressurizing force applied to the sheet is dispersed, so that a satisfactory fold line cannot be formed on the sheet. Moreover, there is also a problem that because it is necessary to match a timing of the nip portion in the roller and a timing at which the sheet enters the nip portion, control is complicated, and this leads to difficulty in achievement of high productivity.

On the other hand, to solve the problem on dispersion of pressure of the fold-enhancing roller, there is disclosed a technology for providing a plurality of fold-enhancing roller pairs whose roller width is smaller than a sheet width, arranging the roller pairs in such a manner that the roller pair is disposed at the center of a fold line of the sheet in an upstream side and the roller pairs are disposed gradually outward of the fold line of the sheet along the downstream side to enhance the fold over the whole sheet, and forming the fold line on the sheet (e.g., Japanese Patent Application Laid-open No. 2007-045531).

However, the technology described in Japanese Patent Application Laid-open No. 2007-045531 has problems as follows. Because the fold at the central portion of the sheet is first enhanced by the fold-enhancing rollers with a high pressurizing force, the both sides of the sheet move slightly upward. Therefore, a phase difference occurs in the way of causing the leading edge of the sheet to enter a nip portion of the fold-enhancing rollers that enhance the fold in the outside of a subsequent sheet to enter, and this causes a deflection in the sheet, so that wrinkles easily occur therein.

As explained above, the technology described in Japanese Patent Application Laid-open No. 2001-019270 has the problems that the pressurizing force applied to the sheet is dispersed and the high productivity is difficult to be obtained because of the complicated control. Furthermore, the technology described in Japanese Patent Application Laid-open No. 2007-045531 has the problems that although the dispersion of the pressurizing force applied to the sheet is prevented, the deflection occurs in the sheet and the wrinkles thereby easily occur.

SUMMARY OF THE INVENTION

It is an object of the present invention to at least partially solve the problems in the conventional technology.

According to an aspect of the present invention, there is provided a sheet folding device that includes a folding unit that applies a fold to a sheet; and a fold-enhancing unit that performs fold enhancement on the sheet applied with the fold by the folding unit. The fold-enhancing unit includes at least two or more rotator pairs each provided with a sheet holding member that holds and pressurizes the sheet applied with the fold, and the sheet holding members of the at least two or more rotator pairs are provided so that an area for holding the sheet shifts from both sides of the sheet toward a central portion of the sheet along a sheet conveying direction from an upstream to a downstream in the fold-enhancing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to accompanying drawings. It should be noted that explanation will be made by exemplifying a fold-enhancing roller pair as a rotator pair for subjecting a sheet to fold enhancement in the embodiments, however, the configuration is not limited thereto.

Figure 1:
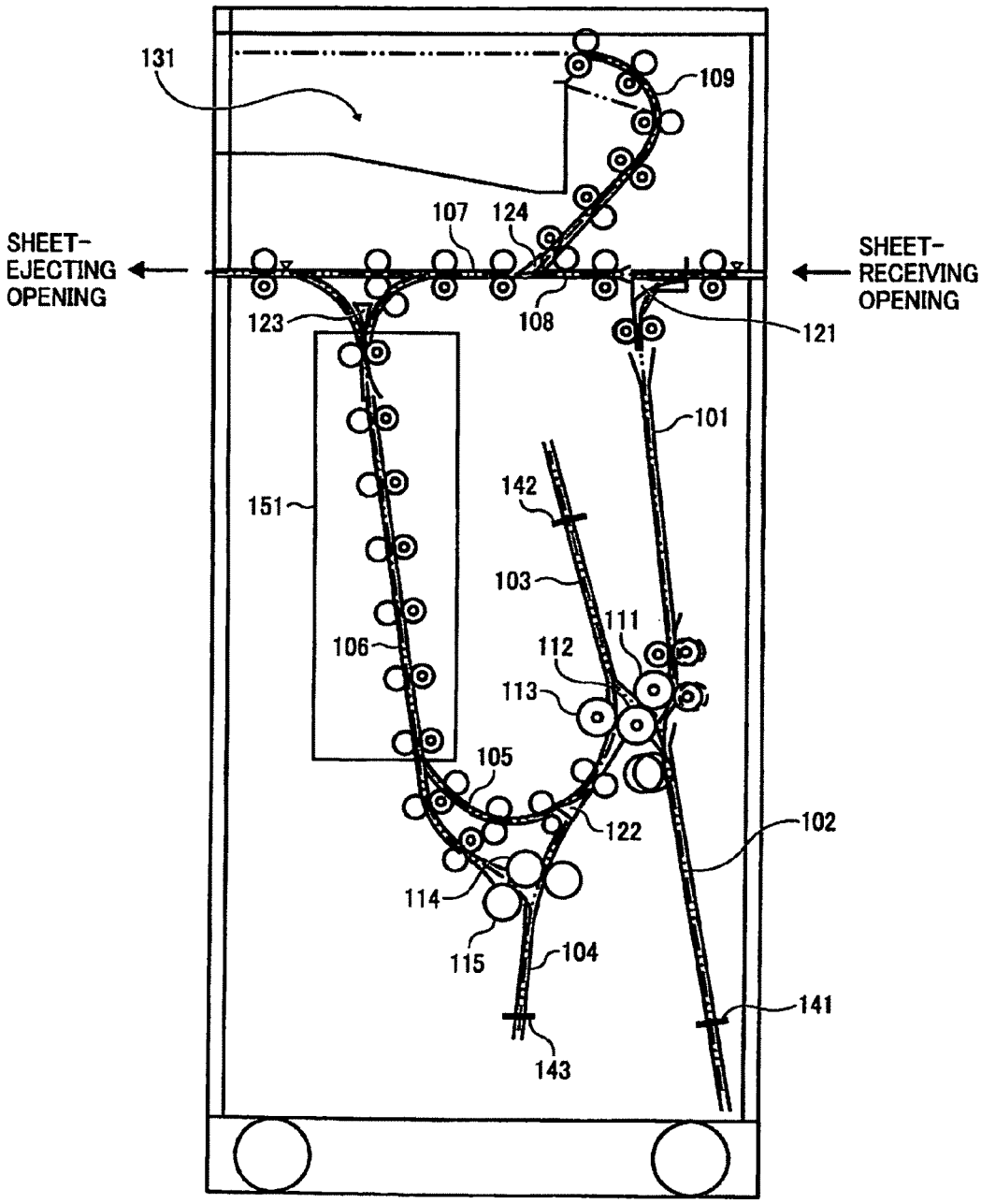
FIG. 1 is a diagram representing a schematic configuration example of a sheet folding device according to embodiments.
Figure 2:
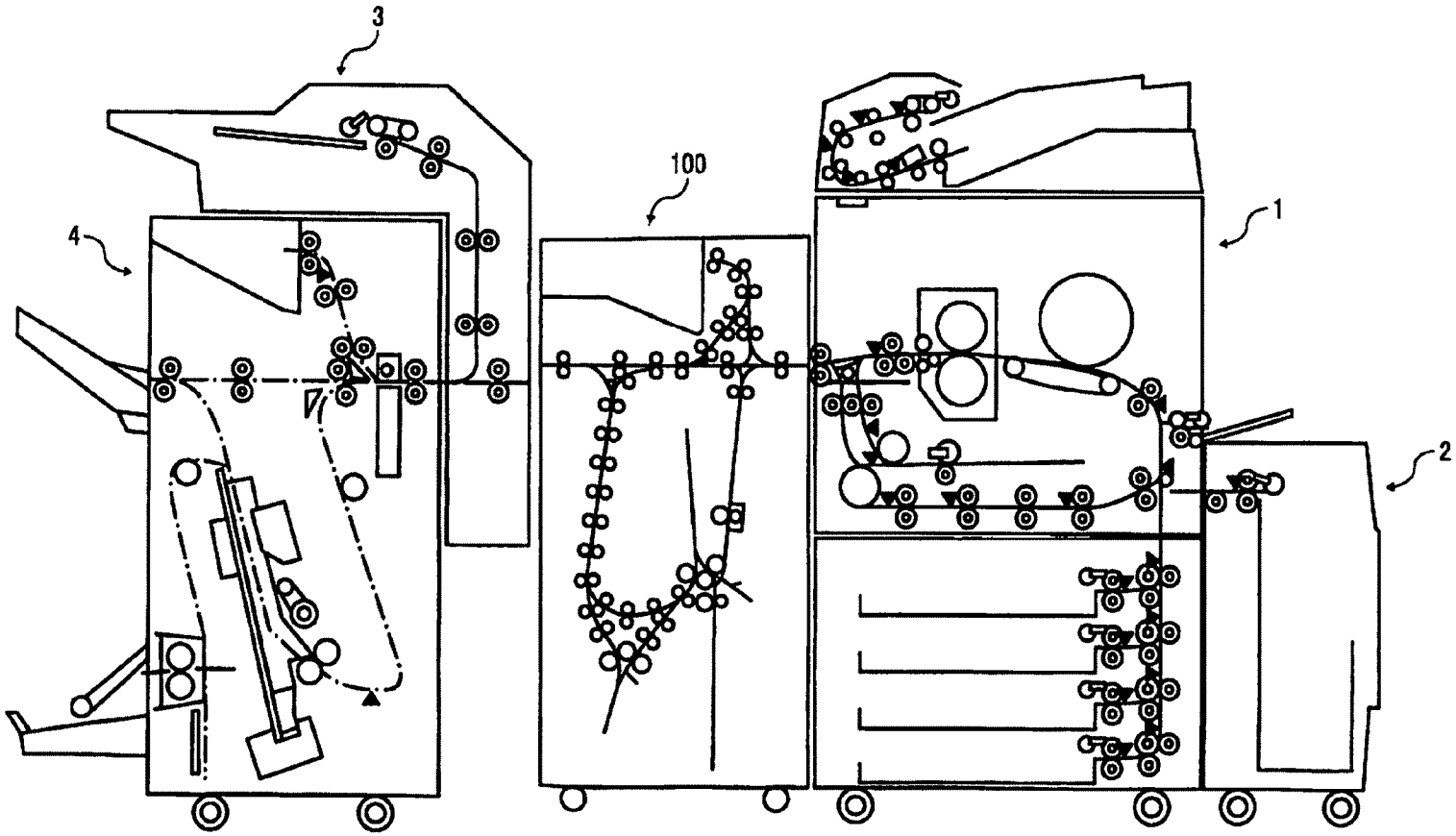
FIG. 2 is a diagram representing a schematic configuration example of an image forming apparatus according to the embodiments.

FIG. 1 represents a schematic configuration example of a sheet folding device according to the embodiments. The configuration shown in FIG. 1 allows folding operations such as single-fold, Z-fold, letter fold-out, letter fold-in, double parallel fold, and closed-gate fold. FIG. 2 represents a schematic configuration example of an image forming apparatus provided with the sheet folding device. As shown in FIG. 2, an image forming apparatus 1 according to the embodiments is connected with a paper feeding device 2, a paper feeding device 3, a post-processing device 4, and a sheet folding device 100. It should be noted that the image forming apparatus is not necessarily provided with the post-processing device and the number of paper feeding devices to be connected is not particularly limited.

A sheet with an image formed thereon by the image forming apparatus 1 is conveyed from the image forming apparatus provided in the upstream side, and is conveyed to the sheet folding device 100 through a sheet-receiving opening in FIG. 1. To convey the sheet to the post-processing device 4 in the downstream side without folding the sheet, the sheet is directly ejected from a sheet-ejecting opening through switching of a first switching claw 121. On the other hand, if folding is to be performed, the sheet is guided to each conveyance path inside the sheet folding device through switching of the first switching claw 121, and folding operations are performed. After the folding operations are completed, a fold-enhancing mechanism 151 enhances the folds.

Next, folding operation examples will be explained in detail below.

<Z-Fold>

FIGS. 3A to 3D are schematics for explaining a Z-folding operation. The Z-folding operation of the sheet folding device 100 according to the embodiments will be explained below with reference to FIGS. 3A to 3D.

Figure 3A:
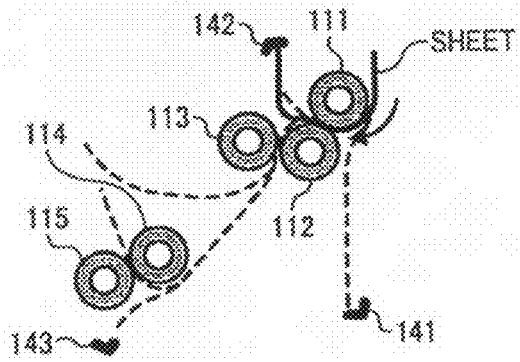
FIGS. 3A to 3D are schematics for explaining a Z-folding operation.

First, as shown in FIG. 3A, a sheet is guided to a first conveyance path 101 through switching of the first switching claw 121. A guide member (not shown) is provided at a nip portion between a first folding roller 111 and a second folding roller 112, and the sheet guided by the operation of the guide member passes through the nip portion between the first folding roller 111 and the second folding roller 112. Next, the leading edge of the sheet hits a second stopper 142 that is movable to a folding position provided in a third conveyance path 103, and the sheet temporarily stops. Here, the nip portion indicates an area where the sheet is held and pressurized to thereby enhance the fold in the sheet.

Figure 3B:
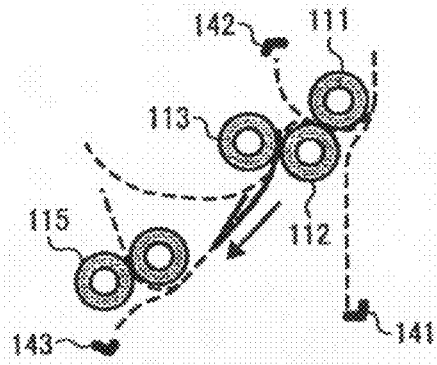
Figure 3C:
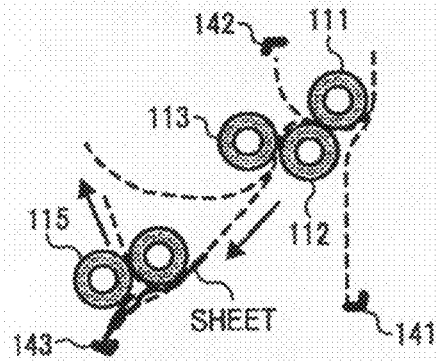
Figure 3D:
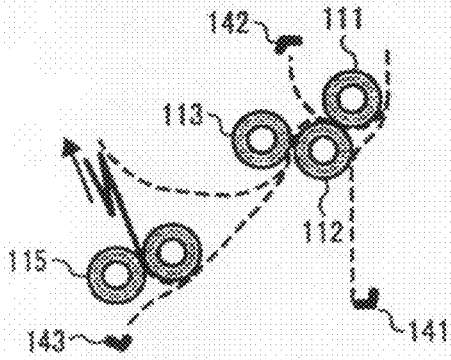

Subsequently, as shown in FIG. 3B, the conveyance of the sheet is restarted, a bent portion of the sheet is caused to enter a nip portion between the second folding roller 112 and a third folding roller 113, where first folding is performed, and then the sheet is conveyed to a fourth conveyance path 104 through switching of a second switching claw 122. As shown in FIG. 3C, the leading edge of the sheet hits a third stopper 143 that is movable to a folding position provided in the fourth conveyance path 104, and the sheet temporarily stops. Thereafter, as shown in FIG. 3D, a bent portion of the sheet is caused to enter a nip portion between a fourth folding roller 114 and a fifth folding roller 115, where second folding is performed, and then the Z-fold is completed.

After the folding is completed, the Z-folded sheet passes through a sixth conveyance path 106 while the folds are enhanced by the fold-enhancing mechanism 151, is guided to a seventh conveyance path 107 by a third switching claw 123, and is stacked in a sheet storage portion 131. If the sheet is to be conveyed to the post-processing device, then the sheet is conveyed to the post-processing device through switching of the third switching claw 123.

<Single-Fold>

A sheet is guided to the first conveyance path 101 through switching of the first switching claw 121. The leading edge of the sheet hits a first stopper 141 that is movable to a folding position provided in a second conveyance path 102, and the sheet temporarily stops. Thereafter, a bent portion of the sheet is caused to enter the nip portion between the first folding roller 111 and the second folding roller 112, where first folding is performed, and then the single-fold is completed.

A guide member (not shown) is provided, and the single-folded sheet guided by the operation of the guide member does not enter the third conveyance path 103, but passes through the nip portion between the second folding roller 112 and the third folding roller 113. Then, the single-folded sheet is guided to a fifth conveyance path 105 by the second switching claw 122.

The single-folded sheet passes through the sixth conveyance path 106 while the fold is enhanced by the fold-enhancing mechanism 151, is guided to the seventh conveyance path 107 by the third switching claw 123, and is stacked in the sheet storage portion 131. If the sheet is to be conveyed to the post-processing device, then the sheet is conveyed to the post-processing device through switching of the third switching claw 123.

<Letter Fold-Out, Letter Fold-In, Double Parallel Fold>

A sheet is guided to the first conveyance path 101 through switching of the first switching claw 121. The leading edge of the sheet hits the first stopper 141 that is movable to the folding position provided in the second conveyance path 102, and the sheet temporarily stops. Thereafter, a bent portion of the sheet is caused to enter the nip portion between the first folding roller 111 and the second folding roller 112, where first folding is performed, and then the sheet is conveyed to the third conveyance path 103.

Next, the leading edge of the sheet hits the second stopper 142 that is movable to the folding position provided in the third conveyance path 103, and the sheet temporarily stops. Then, a bent portion of the sheet is caused to enter the nip portion between the second folding roller 112 and the third folding roller 113, where second folding is performed, and then the folding is completed.

After the folding is completed, the sheet applied with the fold is guided to the fifth conveyance path 105 through the second switching claw 122. The sheet applied with the fold passes through the sixth conveyance path 106 while the fold is enhanced by the fold-enhancing mechanism 151, is guided to the seventh conveyance path 107 by the third switching claw 123, and is stacked in the sheet storage portion 131. If the sheet is to be conveyed to the post-processing device, then the sheet is conveyed to the post-processing device through switching of the third switching claw 123.

<Closed-Gate Fold>

A sheet is guided to the first conveyance path 101 through switching of the first switching claw 121. The leading edge of the sheet hits the first stopper 141 that is movable to the folding position provided in the second conveyance path 102, and the sheet temporarily stops. Thereafter, a bent portion of the sheet is caused to enter the nip portion between the first folding roller 111 and the second folding roller 112, where first folding is performed. Thereafter, the sheet is conveyed to the third conveyance path 103.

Next, the leading edge of the sheet hits the second stopper 142 that is movable to the folding position provided in the third conveyance path 103, and the sheet temporarily stops. Then, conveyance of the sheet is restarted, and a bent portion of the sheet is caused to enter the nip portion between the second folding roller 112 and the third folding roller 113, where second folding is performed. Thereafter, the sheet is conveyed to the fourth conveyance path 104 through switching of the second switching claw 122.

The leading edge of the sheet conveyed to the fourth conveyance path 104 hits the third stopper 143 that is movable to the folding position provided in the fourth conveyance path 104, and the sheet temporarily stops. Then, a bent portion of the sheet is caused to enter the nip portion between the fourth folding roller 114 and the fifth folding roller 115, where third folding is performed, and then the closed-gate fold is completed.

It should be noted that when the leading edge of the sheet hits the third stopper 143 that is movable to the folding position provided in the fourth conveyance path 104 and the sheet temporarily stops and then the bent portion of the sheet is caused to enter the nip portion between the fourth folding roller 114 and the fifth folding roller 115, a closed-gate-folding guide member (not shown) operates, and then the leading edge of the sheet to be caught can be caused to reliably enter the nip portion between the fourth folding roller 114 and the fifth folding roller 115.

After the folding is completed, the closed-gate folded sheet passes through the sixth conveyance path 106 while the fold is enhanced by the fold-enhancing mechanism 151, is guided to the seventh conveyance path 107 by the third switching claw 123, and is stacked in the sheet storage portion 131. If the sheet is to be conveyed to the post-processing device, then the sheet is conveyed to the post-processing device through switching of the third switching claw 123.

Next, a configuration example of the fold-enhancing unit will be explained below.

FIRST EMBODIMENT

Figure 4:
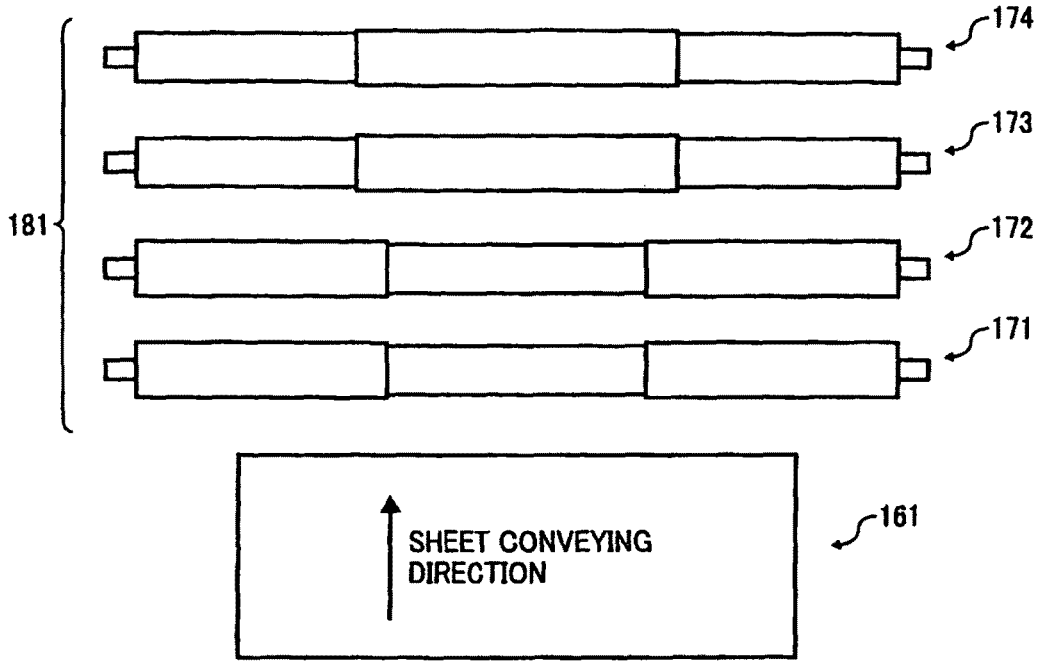
FIG. 4 is a diagram representing a schematic configuration example of a fold-enhancing unit of the sheet folding device according to a first embodiment.

FIG. 4 represents a schematic configuration example of the fold-enhancing unit of the sheet folding device according to a first embodiment. FIG. 4 illustrates an example showing how a sheet 161 applied with a fold by folding rollers (not shown) is conveyed along a conveyance path (not shown). The sheet 161 applied with the fold is conveyed while the fold is enhanced by a fold-enhancing unit 181 that includes a fold-enhancing roller pair 171, a fold-enhancing roller pair 172, a fold-enhancing roller pair 173, and a fold-enhancing roller pair 174.

As shown in FIG. 4, the fold-enhancing roller pair 171 and the fold-enhancing roller pair 172 are configured so that the nip portions thereof hold the both sides of the sheet. More specifically, in the fold-enhancing roller pair 171 and the fold-enhancing roller pair 172, for example, only areas with which the both sides of the sheet come in contact are set as the nip portions, and the other areas thereof are cut out. On the other hand, the fold-enhancing roller pair 173 and the fold-enhancing roller pair 174 are configured so that the nip portions thereof hold the central portion of the sheet. More specifically, in the fold-enhancing roller pair 173 and the fold-enhancing roller pair 174, for example, only area with which the central portion of the sheet comes in contact is set as the nip portion, and the other areas thereof are cut out. It should be noted that the first embodiment will explain the configuration by using an example in which the nip portion is provided on a fold-enhancing driven-roller side of the fold-enhancing roller pair; however, the configuration is not limited thereto. For example, the nip portion can be provided in either one of or both of a fold-enhancing drive-roller and a fold-enhancing driven-roller of the fold-enhancing roller pair.

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced, and the fold enhancement of the sheet 161 is completed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

The first embodiment allows the fold enhancement of the sheet by the fold-enhancing rollers to be successively performed from the both sides to the central portion, so that the strong pressurizing force can thereby be applied to the sheet without decrease of the productivity and occurrence of the undesired deflection causing wrinkles can be suppressed. Namely, it is possible to suppress dispersion of the pressurizing force and occurrence of wrinkles by the simple control.

It should be noted that the first embodiment has explained the configuration by using the example in which there are two fold-enhancing roller pairs configured so that the nip portions hold the both sides of the sheet and there are two fold-enhancing roller pairs configured so that the nip portions hold the central portion of the sheet. However, providing at least one of the fold-enhancing roller pairs in each of them is sufficient to solve the tasks of the present invention.

SECOND EMBODIMENT

Figure 5:
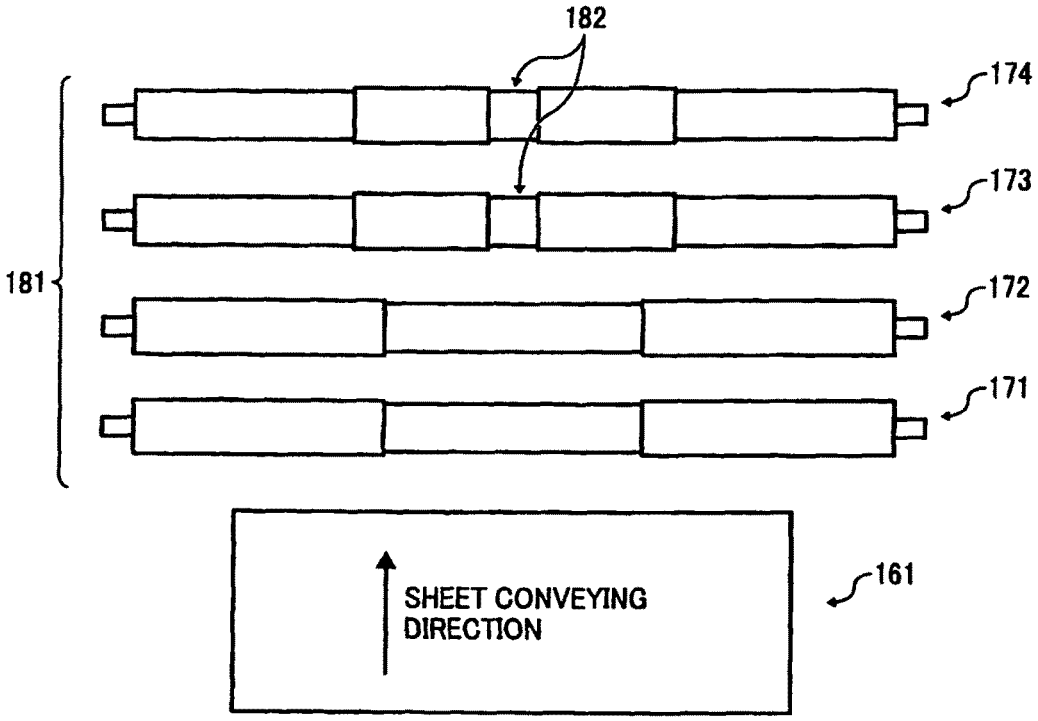
FIG. 5 is a diagram representing a schematic configuration example of a fold-enhancing unit of the sheet folding device according to a second embodiment.

FIG. 5 represents a schematic configuration example of a fold-enhancing unit of the sheet folding device according to the second embodiment. FIG. 5 illustrates an example showing how the sheet 161 applied with a fold by the folding rollers (not shown) is conveyed along the conveyance path (not shown). The sheet 161 applied with the fold is conveyed while the fold is enhanced by the fold-enhancing unit 181 that includes the fold-enhancing roller pair 171, the fold-enhancing roller pair 172, the fold-enhancing roller pair 173, and the fold-enhancing roller pair 174. A different point of the second embodiment from the first embodiment is that a groove 182 with a predetermined length is provided at the central portions of the nip portions in the fold-enhancing roller pair 173 and the fold-enhancing roller pair 174.

It is preferable that a length L of the groove 182 provided in the fold-enhancing roller pair 173 and the fold-enhancing roller pair 174 be $15 \leqq L \leqq 25$ [mm]. However, the length is not limited thereto, and thus the length of the groove 182 can be changed depending on a type and a size of the sheet. Furthermore, the second embodiment has shown the example in which the groove 182 being an area in the nip portion that does not hold the sheet is provided in the fold-enhancing driven-roller of the fold-enhancing roller pair; however, the configuration is not limited thereto. For example, the nip portion can be provided in either one of or both of the fold-enhancing drive-roller and the fold-enhancing driven-roller of the fold-enhancing roller pair.

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced, and the fold enhancement of the sheet 161 is completed. At this time, even if a deflection occurs in the central portion of the sheet when the sheet 161 is passing through the fold-enhancing roller pair 171 and the fold-enhancing roller pair 172, the area where the deflection of the sheet 161 occurs is not pressurized by the nip portions because of the grooves 182 provided in the central portions of the nip portions in the fold-enhancing roller pair 173 and the fold-enhancing roller pair 174, and thus no wrinkles will be formed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

The second embodiment allows, even if the deflection occurs in the sheet, the deflection of the sheet not to be deformed by providing a predetermined area with no pressure applied thereto in the central nip portion of the fold-enhancing roller pair that pressurizes the central portion of the sheet. Thus, it is possible to suppress occurrence of wrinkles in the sheet.

THIRD EMBODIMENT

Figure 6:
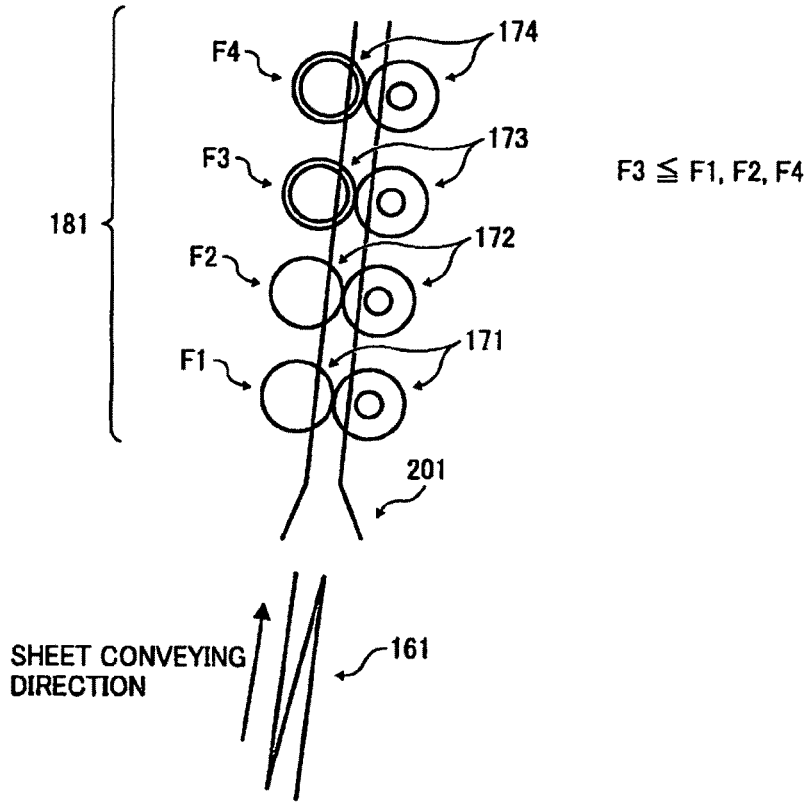
FIG. 6 is a diagram representing a schematic configuration example of a fold-enhancing unit of the sheet folding device according to a third embodiment.

FIG. 6 is a cross section representing a schematic configuration example of a fold-enhancing unit of the sheet folding device according to the third embodiment. FIG. 6 illustrates an example showing how the sheet 161 applied with a fold by the folding rollers (not shown) is conveyed along the conveyance path (not shown). The sheet 161 applied with the fold is guided by a conveying guide member 201 provided on the conveyance path and is conveyed to the fold-enhancing unit 181. The fold-enhancing unit 181 includes the fold-enhancing roller pair 171, the fold-enhancing roller pair 172, the fold-enhancing roller pair 173, and the fold-enhancing roller pair 174, and conveys the sheet 161 while performing the fold enhancement.

The fold-enhancing roller pair 171 and the fold-enhancing roller pair 172 are configured so that the nip portions hold the both sides of the sheet. More specifically, in the fold-enhancing roller pair 171 and the fold-enhancing roller pair 172, for example, only areas with which the both sides of the sheet come in contact are set as the nip portions, and the other areas thereof are cut out. On the other hand, the fold-enhancing roller pair 173 and the fold-enhancing roller pair 174 are configured so that the nip portion holds the central portion of the sheet. More specifically, in the fold-enhancing roller pair 173 and the fold-enhancing roller pair 174, for example, only an area with which the central portion of the sheet comes in contact is set as the nip portion, and the other areas thereof are cut out. It should be noted that the third embodiment will explain the configuration by using an example in which the nip portion is provided in the fold-enhancing driven-roller side of the fold-enhancing roller pair; however, the configuration is not limited thereto. For example, the nip portion can be provided in either one of or both of the fold-enhancing drive-roller and the fold-enhancing driven-roller of the fold-enhancing roller pair.

A pressurizing force (F1) is applied to the fold-enhancing roller pair 171, a pressurizing force (F2) is applied to the fold-enhancing roller pair 172, a pressurizing force (F3) is applied to the fold-enhancing roller pair 173, and a pressurizing force (F4) is applied to the fold-enhancing roller pair 174, each of which is applied to both ends of each roller shaft. At this time, the pressurizing force (F3) is equal to or less than the other pressurizing forces (F1, F2, and F4). As the pressurizing force, it is particularly preferable that $15 \leqq F3 \leqq 30$ [N], and $40 \leqq F1, F2, F4 \leqq 50$ [N].

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced, and the fold enhancement of the sheet is completed. At this time, because the pressurizing force (F3) of the fold-enhancing roller pair 173 is small, even if a deflection occurs in the central portion of the sheet when the sheet 161 is passing through the fold-enhancing roller pair 171 and the fold-enhancing roller pair 172, the deflection in the sheet 161 is corrected by the nip portion of the fold-enhancing roller pair 173, so that no wrinkles will be formed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

The third embodiment allows, even if the deflection occurs in the sheet, the deflection having occurred to be corrected by reducing the pressurizing force of a first fold-enhancing roller with a central nip portion. Thus, it is possible to suppress occurrence of wrinkles.

FOURTH EMBODIMENT

Figure 7:
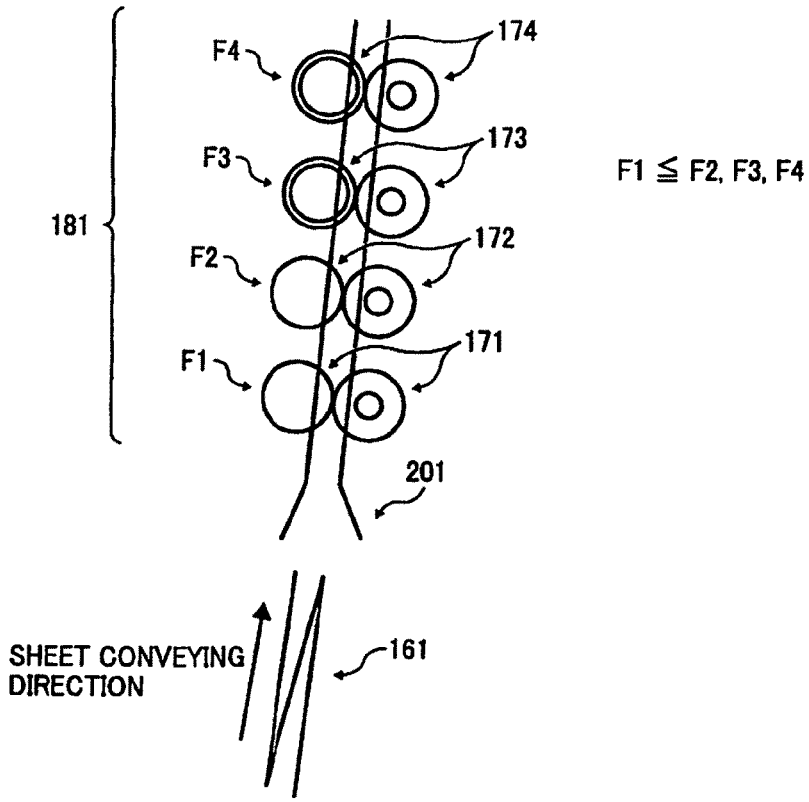
FIG. 7 is a diagram representing a schematic configuration example of a fold-enhancing unit of the sheet folding device according to a fourth embodiment.

FIG. 7 is a cross section representing a schematic configuration example of a fold-enhancing unit of the sheet folding device according to the fourth embodiment. FIG. 7 illustrates an example of how the sheet 161 applied with a fold by the folding rollers (not shown) is conveyed along the conveyance path (not shown). The sheet 161 applied with the fold is guided by the conveying guide member 201 provided on the conveyance path and is conveyed to the fold-enhancing unit 181. The fold-enhancing unit 181 includes the fold-enhancing roller pair 171, the fold-enhancing roller pair 172, the fold-enhancing roller pair 173, and the fold-enhancing roller pair 174, and conveys the sheet 161 while performing the fold enhancement.

The fold-enhancing roller pair 171 and the fold-enhancing roller pair 172 are configured so that the nip portions hold the both sides of the sheet. More specifically, in the fold-enhancing roller pair 171 and the fold-enhancing roller pair 172, for example, only areas with which the both sides of the sheet come in contact are set as the nip portions, and the other areas thereof are cut out. On the other hand, the fold-enhancing roller pair 173 and the fold-enhancing roller pair 174 are configured so that the nip portion holds the central portion of the sheet. More specifically, in the fold-enhancing roller pair 173 and the fold-enhancing roller pair 174, for example, only an area with which the central portion of the sheet comes in contact is set as the nip portion, and the other areas thereof are cut out. It should be noted that the fourth embodiment will explain a configuration by using an example in which the nip portion is provided in the fold-enhancing driven-roller side of the fold-enhancing roller pair; however, the configuration is not limited thereto. For example, the nip portion can be provided in either one of or both of the fold-enhancing drive-roller and the fold-enhancing driven-roller of the fold-enhancing roller pair.

The pressurizing force (F1) is applied to the fold-enhancing roller pair 171, the pressurizing force (F2) is applied to the fold-enhancing roller pair 172, the pressurizing force (F3) is applied to the fold-enhancing roller pair 173, and the pressurizing force (F4) is applied to the fold-enhancing roller pair 174, each of which is applied to both ends of each roller shaft. At this time, the pressurizing force (F1) is equal to or less than the other pressurizing forces (F2, F3, and F4). As the pressurizing force, it is particularly preferable that $15 \leqq F1 \leqq 30$ [N], and $40 \leqq F2, F3, F4 \leqq 50$ [N].

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion. Furthermore, by reducing the pressurizing force (F1) of the fold-enhancing roller pair 171, the sheet 161 is pressurized step by step without applying a strong pressurizing force thereto. With this feature, the deflection is harder to be formed in the sheet 161, which allows occurrence of wrinkles to be suppressed.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced, and the fold enhancement of the sheet is completed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

Against concern about the occurrence of the deflection in the sheet, the fourth embodiment allows the pressurizing force of the first fold-enhancing roller that includes the nip portions contacting the both sides of the sheet to be reduced, the deflection to be thereby harder to occur in the sheet, and occurrence of wrinkles in the sheet to be suppressed. In other words, by performing the fold enhancement strongly step by step, it is possible to suppress the deflection in the central portion of the sheet, and further suppress occurrence of wrinkles.

FIFTH EMBODIMENT

Figure 8:
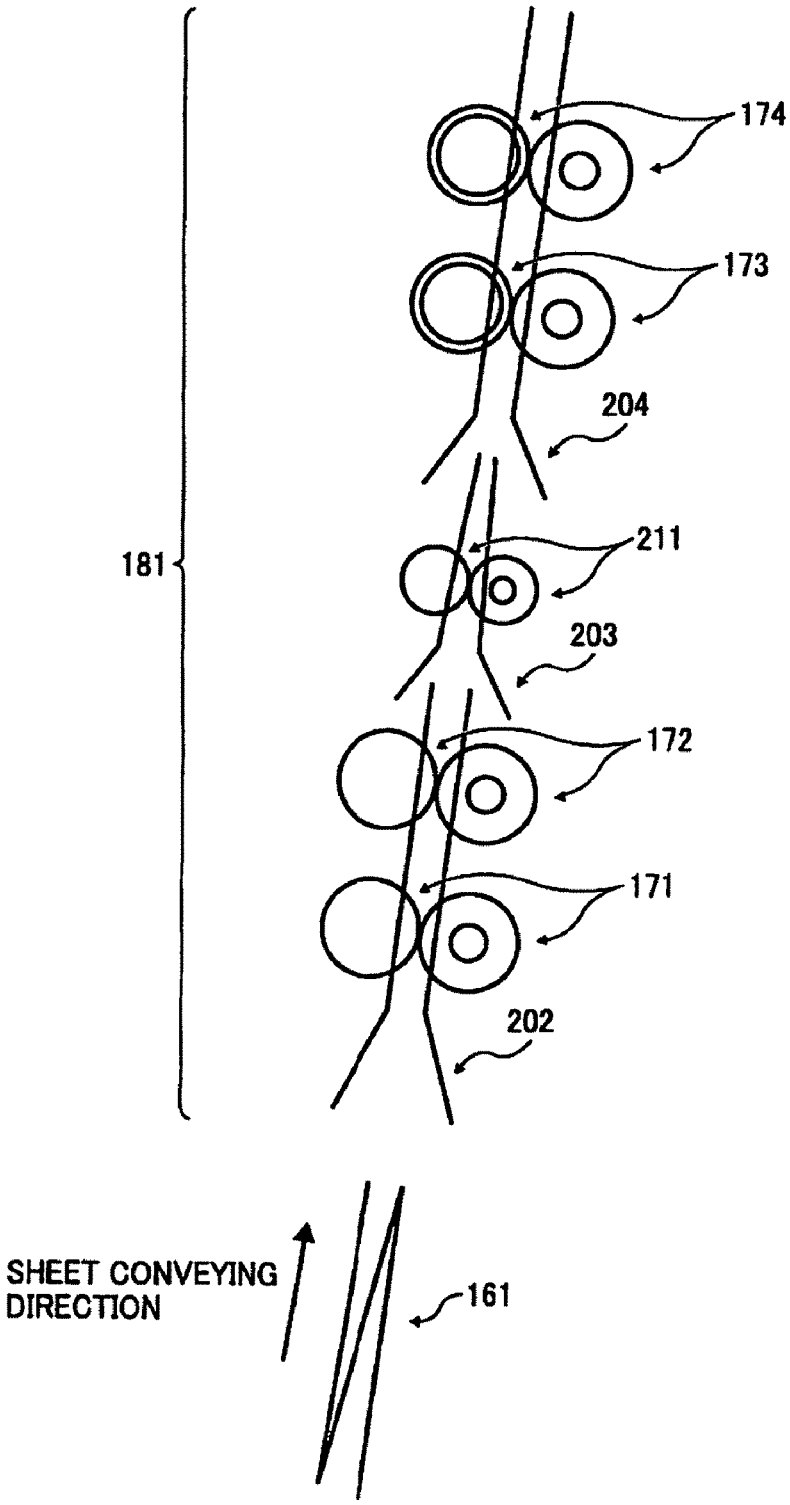
FIG. 8 is a diagram representing a schematic configuration example of a fold-enhancing unit of the sheet folding device according to a fifth embodiment.

FIG. 8 is a cross section representing a schematic configuration example of a fold-enhancing unit of the sheet folding device according to the fifth embodiment. FIG. 8 illustrates an example showing how the sheet 161 applied with a fold by the folding rollers (not shown) is conveyed along the conveyance path (not shown). The sheet 161 applied with the fold is guided by a conveying guide member 202 provided on the conveyance path and is conveyed to the fold-enhancing unit 181. The fold-enhancing unit 181 includes the fold-enhancing roller pair 171, the fold-enhancing roller pair 172, the fold-enhancing roller pair 173, the fold-enhancing roller pair 174, a conveying roller pair 211, a tapered conveying guide member 203, and a conveying guide member 204, and conveys the sheet 161 while performing the fold enhancement. It should be noted that a minimum conveying space in a most downstream portion of the tapered conveying guide member 203 is preferably equal to or less than a fold height of the sheet 161. Moreover, the conveying roller pair 211 is smaller in pressurizing force and surface roughness than these of the fold-enhancing roller pairs.

The fold-enhancing roller pair 171 and the fold-enhancing roller pair 172 are configured so that the nip portions hold the both sides of the sheet. More specifically, in the fold-enhancing roller pair 171 and the fold-enhancing roller pair 172, for example, only areas with which the both sides of the sheet come in contact are set as the nip portions, and the other areas thereof are cut out. On the other hand, the fold-enhancing roller pair 173 and the fold-enhancing roller pair 174 are configured so that the nip portion holds the central portion of the sheet. More specifically, in the fold-enhancing roller pair 173 and the fold-enhancing roller pair 174, for example, only an area with which the central portion of the sheet comes in contact is set as the nip portion, and the other areas thereof are cut out. It should be noted that the fifth embodiment will explain a configuration by using an example in which the nip portion is provided in the fold-enhancing driven-roller side of the fold-enhancing roller pair; however, the configuration is not limited thereto. For example, the nip portion can be provided in either one of or both of the fold-enhancing drive-roller and the fold-enhancing driven-roller of the fold-enhancing roller pair.

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 is conveyed, inside the tapered conveying guide member 203 in which a fold height direction of the sheet is narrowed in a tapered manner, by the conveying roller pair 211 fixed to the tapered conveying guide member 203. Then, the sheet 161 enters the nip portion of the fold-enhancing roller pair 173 and enters the nip portion of the fold-enhancing roller pair 174, where the fold in the central portion of the sheet is enhanced and the fold enhancement of the sheet 161 is completed. At this time, because the conveying space of the tapered conveying guide member 203 controls the fold height of the sheet 161, even if a deflection occurs in the central portion of the sheet while the sheet 161 is passing through the fold-enhancing roller pair 171 and the fold-enhancing roller pair 172, the deflection of the sheet 161 is corrected by the tapered potion and the conveying roller pair 211 where the sheet 161 can slip, so that no wrinkles will be formed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

The fifth embodiment has explained the configuration by using the example in which the fold-enhancing unit 181 is provided with one each of the conveying roller pair 211 and the tapered conveying guide member 203; however, the configuration is not limited thereto. For example, if the fold-enhancing unit 181 is provided with three types or more of the fold-enhancing rollers in which the nip portions are provided in different positions, two or more of the conveying roller pairs 211 and tapered conveying guide members 203 can be also provided respectively.

The fifth embodiment allows, even if the deflection occurs in the sheet, the sheet after the fold in both sides thereof is enhanced to pass through the tapered guide plate and the deflection having occurred to be corrected. Therefore, occurrence of wrinkles in the sheet can be suppressed. More specifically, there are provided, between the fold-enhancing roller pairs with different positions of the nip portions among the fold-enhancing roller pairs included in the fold-enhancing unit, the conveying guide member in which the fold height direction of the sheet is narrowed in the tapered manner toward the downstream side in the sheet conveying direction and the minimum conveying space controls the fold height of the sheet; and the conveying roller pair disposed in the conveying guide member. This allows the deflection formed in the central portion to be corrected and occurrence of the wrinkles to be further suppressed.

SIXTH EMBODIMENT

Figure 9:
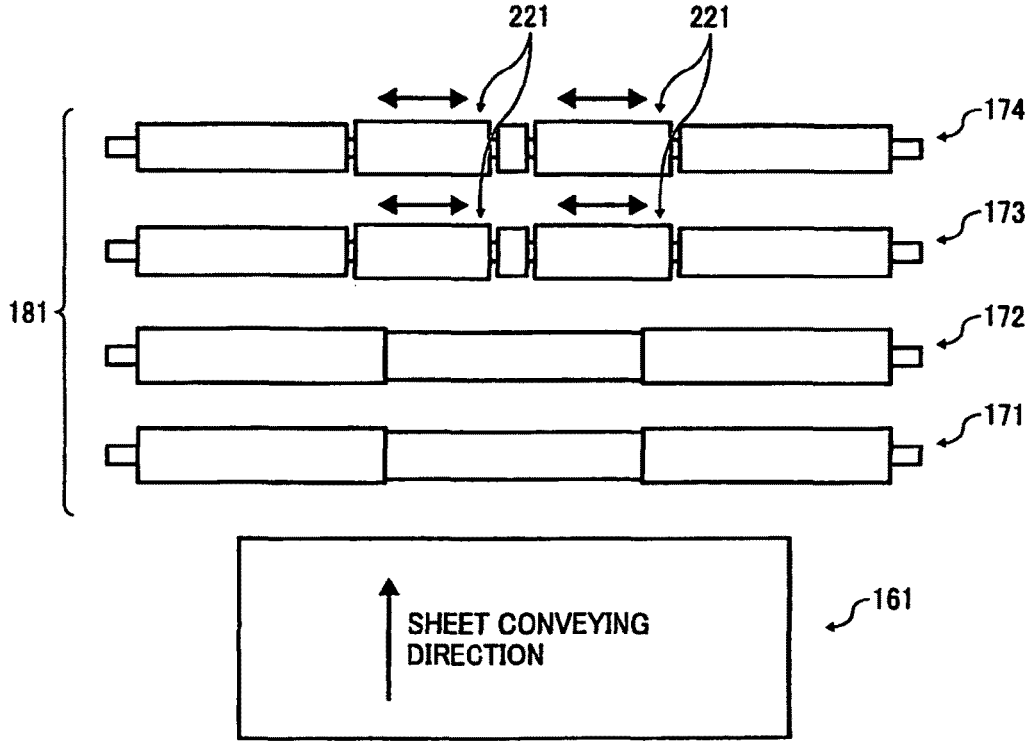
FIG. 9 is a diagram representing a schematic configuration example of a fold-enhancing unit of the sheet folding device according to a sixth embodiment.

FIG. 9 represents a schematic configuration example of a fold-enhancing unit of the sheet folding device according to the sixth embodiment. FIG. 9 illustrates an example showing how the sheet 161 applied with a fold by the folding rollers (not shown) is conveyed along the conveyance path (not shown). The sheet 161 applied with the fold is conveyed while the fold is enhanced by the fold-enhancing unit 181 that includes the fold-enhancing roller pair 171, the fold-enhancing roller pair 172, the fold-enhancing roller pair 173, and the fold-enhancing roller pair 174. A different point of the sixth embodiment from the first embodiment is that nip portions in the fold-enhancing roller pair 173 and the fold-enhancing roller pair 174 are fold-enhancing driven-sliding nips 221. The driven sliding nips 221 each can freely slide within a predetermined distance along the roller shafts of the rollers by force in a resist direction. It should be noted that, as shown in FIG. 9, a groove is provided in the nip portions of the fold-enhancing roller pair 173 and the fold-enhancing roller pair 174, and that the nip portion is separated into portions at the groove and the portions are made independent, and this allows the nip portions in the fold-enhancing roller pair 173 and the fold-enhancing roller pair 174 to be the driven sliding nips.

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced and the fold enhancement of the sheet is completed. At this time, even if the deflection occurs in the central portion of the sheet when the sheet 161 is passing through the fold-enhancing roller pair 171 and the fold-enhancing roller pair 172, the fold-enhancing driven-roller sliding nips 221 in the fold-enhancing roller pair 173 and the fold-enhancing roller pair 174 slide due to force in the resist direction of the sheet so as to recover the deflection, and absorb the force. With this feature, the deflection of the sheet 161 is corrected, and thus, wrinkles will not be formed in the sheet 161. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

The sixth embodiment allows, even if the deflection occurs in the sheet, the deflection not to be deformed by providing the groove in the central nip portion, the force applied due to the deflection to be absorbed from the sheet by giving the sliding capability to the nip portion, and the deflection having occurred to be corrected. Therefore, it is possible to suppress occurrence of wrinkles in the sheet. More specifically, roller nip portions separated at the groove provided in the nip central portion of the fold-enhancing roller pair for enhancing the fold in the central portion of the sheet have a certain degree of freedom with respect to the axial direction, and the roller nip absorbs part of the force applied in the resist direction from the sheet, so that the roller nip portion can move along the roller shaft. The force applied from the roller to the sheet is thereby reduced and the deflection is thereby corrected, which allows occurrence of wrinkles to be further suppressed.

SEVENTH EMBODIMENT

Figure 10:
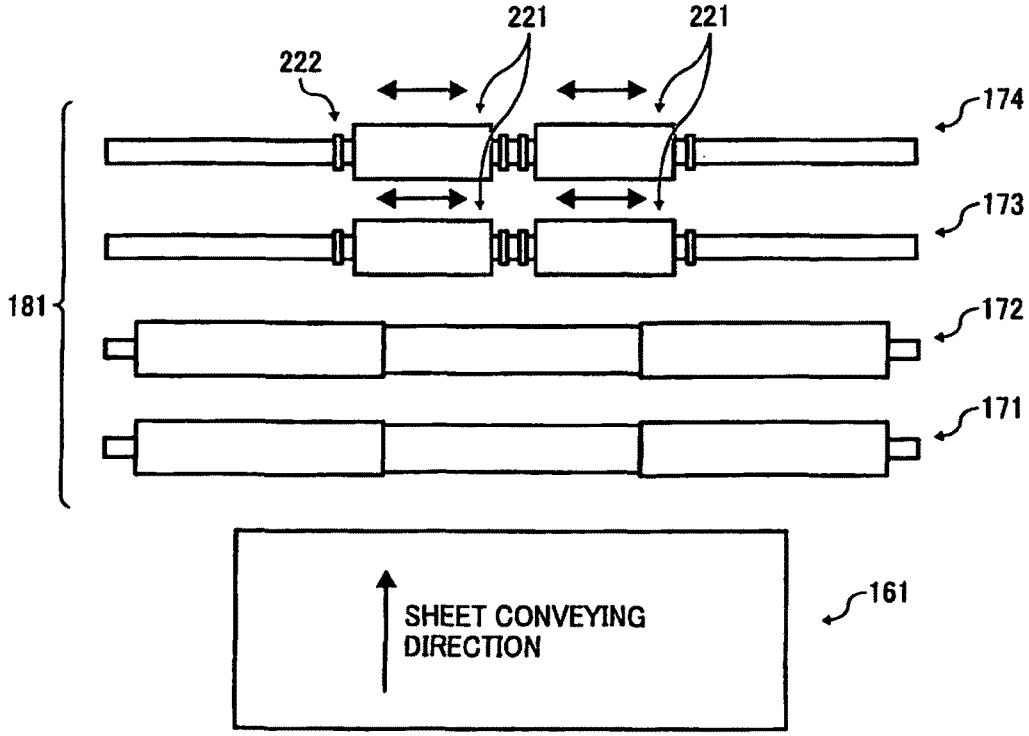
FIG. 10 is a diagram representing a schematic configuration example of a fold-enhancing unit of the sheet folding device according to a seventh embodiment.

FIG. 10 represents a schematic configuration example of a fold-enhancing unit of the sheet folding device according to the seventh embodiment. FIG. 10 illustrates an example showing how the sheet 161 applied with a fold by the folding rollers (not shown) is conveyed along the conveyance path (not shown). The sheet 161 applied with the fold is conveyed while the fold is enhanced by the fold-enhancing unit 181 that includes the fold-enhancing roller pair 171, the fold-enhancing roller pair 172, the fold-enhancing roller pair 173, and the fold-enhancing roller pair 174.

Different points of the seventh embodiment from the first embodiment are that nip portions in the fold-enhancing roller pair 173 and the fold-enhancing roller pair 174 are fold-enhancing driven-sliding nips 221 and that retaining rings 222 are provided. The driven sliding nips 221 each can freely slide within a predetermined distance along the roller shafts of the rollers by the force in the resist direction. It should be noted that a slidable distance of the fold-enhancing driven-roller sliding nip 221 is restricted by the retaining rings 222 disposed on the fold-enhancing roller pair 173 and the fold-enhancing roller pair 174. In this manner, the retaining rings 222 function as adjusting units for adjusting each movable range of the nip portions separated by the groove.

Although FIG. 10 illustrates the example in which four retaining rings 222 are arranged in each of the fold-enhancing roller pair 173 and the fold-enhancing roller pair 174, the number is not limited thereto. Moreover, a plurality of retaining-ring grooves (not shown) is provided on each shaft of the fold-enhancing rollers, and thus, an arrangement of the retaining rings 222 can be freely changed between the retaining-ring grooves.

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced and the fold enhancement of the sheet is completed. At this time, even if the deflection occurs in the central portion of the sheet when the sheet 161 is passing through the fold-enhancing roller pair 171 and the fold-enhancing roller pair 172, the fold-enhancing driven-roller sliding nips 221 in the fold-enhancing roller pair 173 and the fold-enhancing roller pair 174 slide due to the force in the resist direction of the sheet so as to recover the deflection, and absorb the force. With this feature, the deflection of the sheet 161 is corrected, and thus, wrinkles will never occur in the sheet 161.

The deflection that possibly occurs in the sheet 161 is different depending on a size, a thickness, and a quality of the sheet, and a type of fold. Therefore, by changing positions of the retaining rings 222 arranged in the fold-enhancing roller pair 173 and the fold-enhancing roller pair 174 and changing a slidable range of the fold-enhancing driven-roller sliding nips 221, these can deal with various deflections.

The seventh embodiment allows wider types of deflections to be dealt with and the deflection occurring in the sheet to be corrected by enabling the slidable range of the nip portions to be adjusted in consideration that the deflection occurring in the sheet is different depending on the type and the size of the sheet and the type of fold.

EIGHTH EMBODIMENT

Figure 11:
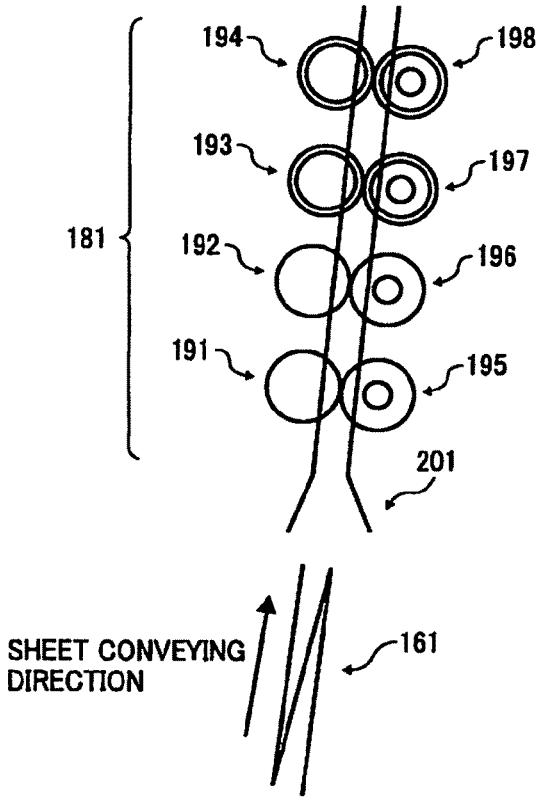
FIG. 11 is a diagram representing a schematic configuration example of a fold-enhancing unit of the sheet folding device according to a eighth embodiment.

FIG. 11 represents a schematic configuration example of a fold-enhancing unit of the sheet folding device according to the eighth embodiment. FIG. 11 illustrates an example showing how the sheet 161 applied with a fold by the folding rollers (not shown) is conveyed along the conveyance path (not shown). The sheet 161 applied with the fold is guided by the conveying guide member 201 provided in the conveyance path and is conveyed to the fold-enhancing unit 181. The fold-enhancing unit 181 includes the fold-enhancing roller pair 171, the fold-enhancing roller pair 172, the fold-enhancing roller pair 173, and the fold-enhancing roller pair 174, and conveys the sheet 161 while enhancing the fold thereof. The fold-enhancing roller pair 171 includes a fold-enhancing driven-roller 191 being a driven rotator and a fold-enhancing drive-roller 195 being a drive rotator, and the fold-enhancing roller pair 172 includes a fold-enhancing driven-roller 192 and a fold-enhancing drive-roller 196. Likewise, the fold-enhancing roller pair 173 includes a fold-enhancing driven-roller 193 and a fold-enhancing drive-roller 197, and the fold-enhancing roller pair 174 includes a fold-enhancing driven-roller 194 and a fold-enhancing drive-roller 198. The fold-enhancing drive-rollers have the same configuration as that of corresponding fold-enhancing driven-rollers, respectively.

The sheet 161 applied with the fold enters the nip portions of the fold-enhancing roller pair 171 and then enters the nip portions of the fold-enhancing roller pair 172, where the fold in both sides of the sheet is enhanced. At this time, the central portion of the sheet not held by the nip portions of the fold-enhancing roller pair 171 and the fold-enhancing roller pair 172 is conveyed by being pulled by the both sides of the sheet held by the nip portions of the fold-enhancing roller pair 171 and the fold-enhancing roller pair 172, and thus, undesired deflection is hard to be formed at the leading edge of the sheet in its central portion.

The sheet 161 having passed through the fold-enhancing roller pair 172 then enters the nip portion of the fold-enhancing roller pair 173 and enters the nip portion of the fold-enhancing roller pair 174, where the fold in the central portion of the sheet is enhanced and the fold enhancement of the sheet is completed. At this time, because the drive-side fold-enhancing roller in each of the fold-enhancing roller pairs has the same configuration as that of the driven-side fold-enhancing roller, unevenness in the conveying force of the fold-enhancing roller for conveying the sheet 161 can thereby be prevented and the deflection having occurred is more easily released, and thus, wrinkles will not be formed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet.

Against concern about the occurrence of the deflection in the sheet, the eighth embodiment allows prevention of the unevenness in the force applied to the sheet, and release of the deflection, or correction to be easily preformed by forming the drive-side roller into the same form as that of the driven-side roller, and thus suppression of the occurrence of wrinkles.

NINTH EMBODIMENT

Figure 12:
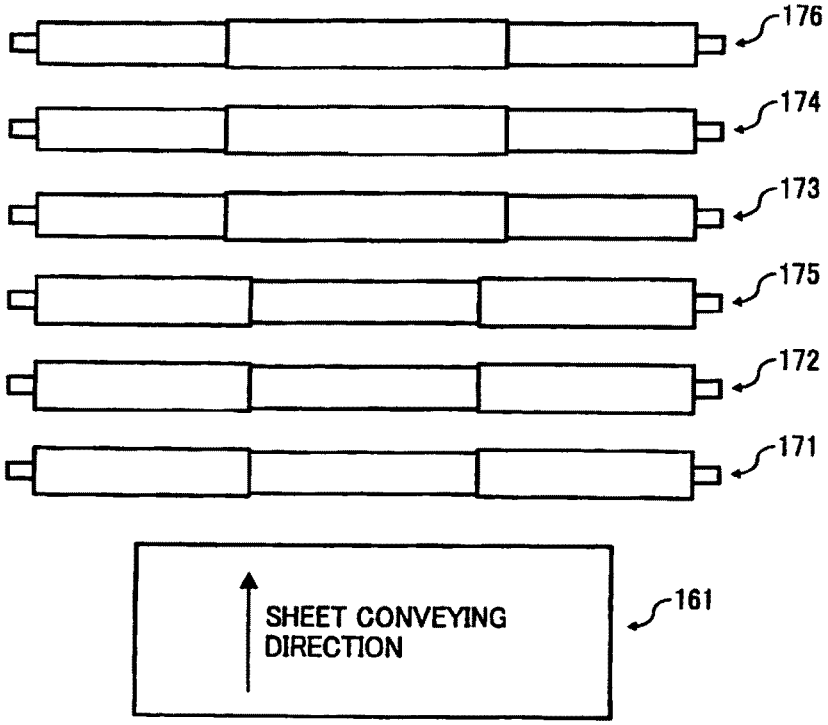
FIG. 12 is a diagram representing a schematic configuration example of a fold-enhancing unit of the sheet folding device according to a ninth embodiment.

FIG. 12 represents a schematic configuration example of a fold-enhancing unit of the sheet folding device according to the ninth embodiment. FIG. 12 illustrates an example showing how the sheet 161 applied with a fold by the folding rollers (not shown) is conveyed along the conveyance path (not shown). The sheet 161 applied with the fold is conveyed while the fold is enhanced by the fold-enhancing unit 181 that includes the fold-enhancing roller pair 171, the fold-enhancing roller pair 172, the fold-enhancing roller pair 173, the fold-enhancing roller pair 174, a fold-enhancing roller pair 175, and a fold-enhancing roller pair 176.

The sheet 161 applied with the fold enters the nip portions of the fold-enhancing roller pair 171, enters the nip portions of the fold-enhancing roller pair 172, and then enters the nip portions of the fold-enhancing roller pair 175, where the fold in both sides of the sheet is enhanced. At this time, the central portion of the sheet not held by the nip portions of the fold-enhancing roller pair 171, the fold-enhancing roller pair 172, and the fold-enhancing roller pair 175 is conveyed by being pulled by the both sides of the sheet held by the nip portions of the fold-enhancing roller pair 171, the fold-enhancing roller pair 172, and the fold-enhancing roller pair 175, and thus, undesired deflection is hard to be formed at the leading edge of the sheet in its central portion.

The sheet 161 having passed through the fold-enhancing roller pair 175 then enters the nip portion of the fold-enhancing roller pair 173, enters the nip portion of the fold-enhancing roller pair 174, and enters the fold-enhancing roller pair 176, where the fold in the central portion of the sheet is enhanced and the fold enhancement of the sheet is completed. Here, each of the nip portions of the fold-enhancing roller pairs that constitute the fold-enhancing unit 181 is narrower than the sheet width, and this allows the pressure to be intensively applied to the sheet 161, thus forcefully forming the fold line on the sheet. It should be noted that by arranging a plurality of fold-enhancing roller pairs (171, 172, 175) for enhancing the fold in both sides of the sheet and a plurality of fold-enhancing roller pairs (173, 174, 176) for enhancing the fold in the central portion of the sheet, stronger pressurizing force can be applied to the sheet.

The ninth embodiment allows repetitive application of load to the sheet by providing the plurality of fold-enhancing rollers and a desired fold line to be obtained.

The ninth embodiment has explained the configuration by using the example in which the three fold-enhancing roller pairs for enhancing the fold in both sides of the sheet and the three fold-enhancing roller pairs for enhancing the fold in the central portion of the sheet are provided; however, the number is not limited thereto. Therefore, each of them may be configured so as to provide three or more of the roller pairs.

The explanation of the present invention has been made by using the examples of the first to the ninth embodiments; however, two or three or more of the embodiments can also be combined.

The embodiments have explained the configuration by using the examples in which the nip portion is provided in the fold-enhancing driven-roller side of the fold-enhancing roller pair; however, the location is not limited thereto. For example, the nip portion can also be provided in either one of or both of the fold-enhancing drive-roller and the fold-enhancing driven-roller of the fold-enhancing roller pair.

The embodiments have explained the configuration by using the example in which the fold-enhancing unit includes the two types of fold-enhancing roller pairs: the fold-enhancing roller pair configured so as to hold the both sides of the sheet by the nip portions and the fold-enhancing roller pair configured so as to hold the central portion of the sheet by the nip portion; however, the configuration is not limited thereto. It goes without saying that, for example, the fold-enhancing unit can be provided with three types or more of the fold-enhancing roller pairs in such a manner that the nip portions are arranged in a sequentially shifted manner from the both sides of the sheet toward the central portion thereof.

Here, a pressure adjusting mechanism of the fold-enhancing mechanism in the sheet folding device according to the ninth embodiment will be explained with reference to FIG. 13.

Figure 13:
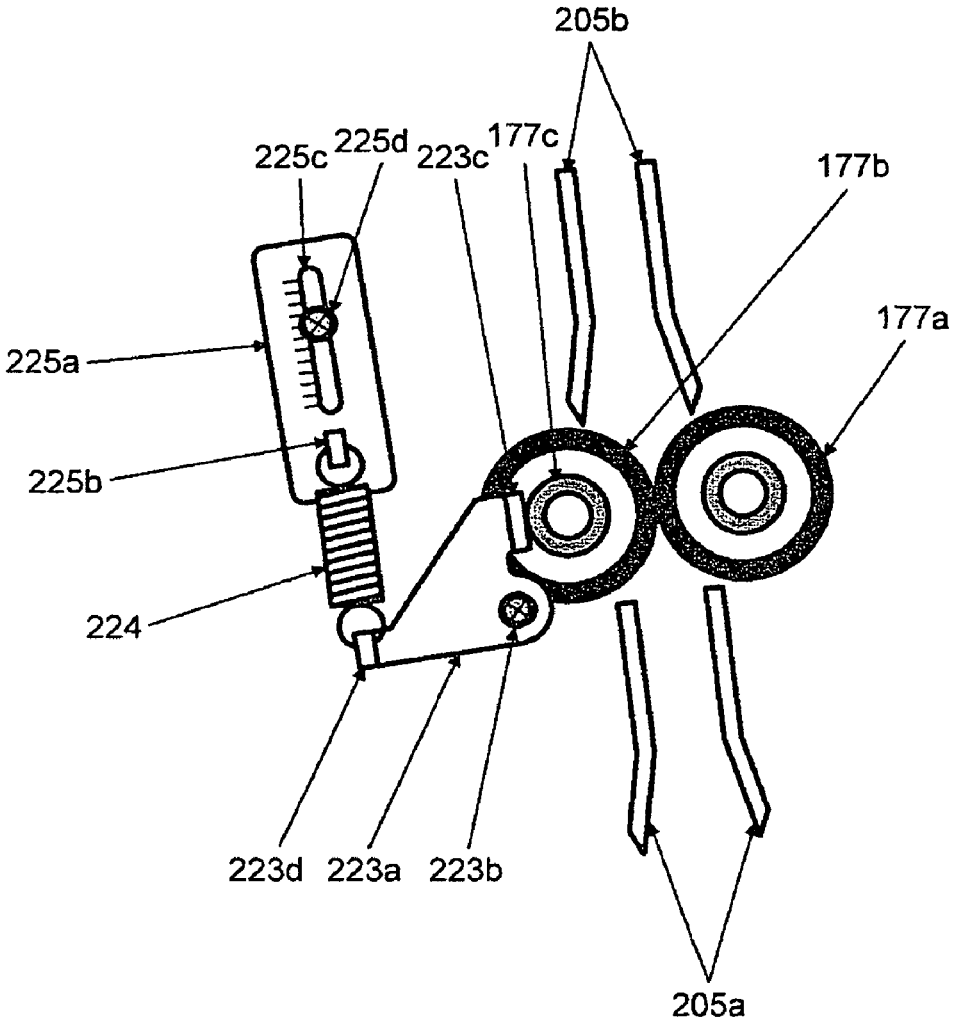
FIG. 13 is a diagram illustrating a schematic configuration example of a pressure adjusting mechanism of the sheet folding devices according to the present embodiments.

The sheet folding device shown in FIG. 13 is provided with a conveying guide member 205*a* on the upstream side in the conveyance path and a conveying guide member 205*b* on the downstream side in the conveyance path along the conveyance path of the sheet. Arranged in the sheet folding device shown in FIG. 13 is a fold-enhancing roller pair composed of a fold-enhancing drive-roller 177*a* and a fold-enhancing driven-roller 177*b*. The sheet subjected to a folding process on the upstream side in the sheet folding device is conveyed by a conveying unit along the upstream side in the conveyance path and is further conveyed to the fold-enhancing roller pair by being guided by the conveying guide member 205*a*. With this feature, the sheet subjected to the folding process is subjected to fold enhancement. The sheet subjected to the fold enhancement receives the conveying force from the fold-enhancing roller pair, and, further, is guided by the conveying guide member 205*b* to be conveyed to the downstream side in the conveyance path.

The fold-enhancing drive-roller 177*a* is a drive rotator that rotates by receiving the drive force by a drive unit (not shown). Meanwhile, the fold-enhancing driven-roller 177*b* is a driven rotator that is provided so as to be in contact with the fold-enhancing drive-roller 177*a* and rotates without slip. A rotating shaft of the fold-enhancing driven-roller 177*b* is fixed to a fold-enhancing driven-roller bearing 177*c*. The fold-enhancing driven-roller bearing 177*c* is disposed in a long hole in a side plate (not shown) of the sheet folding device, and has a degree of freedom only in a linear direction connecting between the shaft of the fold-enhancing drive-roller 177*a* and the nip portion of the fold-enhancing roller pair.

Fixed to the side plate of the sheet folding device is a tensioner 223*a* by a shoulder screw 223*b*, and the tensioner 223*a* is rotatable around the shoulder screw 223*b*. The tensioner 223*a* includes a tensioner operating point portion 223*c* and a tensioner force point portion 223*d*. In the tensioner 223*a*, by applying the force to the tensioner force point portion 223*d*, moment is applied to the tensioner operating point portion 223*c* around the shoulder screw 223*b*, the fold-enhancing driven-roller 177*b* is pressed against the fold-enhancing drive-roller 177*a* through the fold-enhancing driven-roller bearing 177*c*, and the fold-enhancing roller pair is thereby pressurized.

Fixed also to the side plate of the sheet folding device is a pressure adjusting plate 225*a* by a pressure adjusting screw 225*d*. The pressure adjusting plate 225*a* includes an adjusting hole 225*c* of the pressure adjusting plate with scales and a spring fixing portion 225*b* of the pressure adjusting plate. The spring fixing portion 225*b* of the pressure adjusting plate is connected to the tensioner force point portion 223*d* through a spring 224. More specifically, the force applied to the tensioner force point portion 223*d* is elastic force due to extension of the spring 224. Moreover, because the adjusting hole 225*c* of the pressure adjusting plate is a long hole, the pressure adjusting plate 225*a* can move in parallel to a coil central axis of the spring 224, and can be fixed by the pressure adjusting screw 225*d*. By adjusting a moving amount of the pressure adjusting plate 225*a*, the extension of the spring 224 changes, and thus, the force applied to the tensioner force point portion 223*d* also changes due to Hooke's law. This allows adjustment of the pressurizing force of the fold-enhancing roller pair. The pressure may be adjusted by keeping the position of the pressure adjusting plate 225*a* as it is and using springs with different spring constants.

The above explanation has been made by using the example in which the spring 224 is used as an elastic body that changes the force applied to the tensioner force point portion 223*d*, however, the elastic body is not particularly limited thereto. Moreover, the screw is not necessarily used for the configuration to fix the pressure adjusting plate 225*a*, and thus the configuration can be changed as required.

Programs for causing a CPU to execute the processes of folding operation and fold-enhancing operation constitute a program according to the present invention. As a computer-readable recording medium for recording the program, a semiconductor storage unit and an optical and/or a magnetic storage unit can be used. The program and the recording medium are used in a system with a configuration different from that of the embodiments and the program is executed by a CPU of the system, thus obtaining the substantially same effect as that of the present invention.

According to the present invention, it is possible to suppress dispersion of the pressurizing force applied to the sheet and suppress occurrence of wrinkles while maintaining high productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding device comprising:

a folding unit that applies a fold to a sheet; and a fold-enhancing unit that performs fold enhancement on the sheet applied with the fold by the folding unit, wherein the fold-enhancing unit includes at least two or more rotator pairs each provided with a sheet holding member that holds and pressurizes the sheet applied with the fold, and the sheet holding members of the at least two or more rotator pairs are provided so that an area for holding the sheet shifts from both sides of the sheet toward a central portion of the sheet along a sheet conveying direction from an upstream to a downstream in the fold-enhancing unit.

2. The sheet folding device according to claim 1, wherein the fold-enhancing unit includes at least one first rotator pair provided with the sheet holding member so as to enhance the fold in the both sides of the sheet, and at least one second rotator pair that is provided in a downstream of the first rotator pair and is provided with the sheet holding member so as to enhance the fold in the central portion of the sheet.

3. The sheet folding device according to claim 1, wherein the rotator pair includes a drive rotator and a driven rotator, and the sheet holding member is provided in at least one of the drive rotator and the driven rotator.

4. The sheet folding device according to claim 1, wherein the rotator pair includes a drive rotator and a driven rotator, and the sheet holding member is provided in the driven rotator.

5. The sheet folding device according to claim 1, wherein the sheet holding member provided in the rotator pair that enhances the fold in the central portion of the sheet includes a predetermined area that does not hold the sheet so as not to pressurize an area where deflection occurs in the sheet.

6. The sheet folding device according to claim 5, wherein the sheet holding member is separated by the predetermined area that does not hold the sheet, the separated sheet holding members have a predetermined degree of freedom along a shaft of the rotator, so that the separated sheet holding members are movable along the shaft of the rotator.

7. The sheet folding device according to claim 6, wherein the fold-enhancing unit includes an adjusting unit that adjusts a movable range of the sheet holding members separated by the predetermined area that does not hold the sheet.

8. The sheet folding device according to claim 7, wherein the adjusting unit is a retaining ring provided on the shaft of the rotator, and the rotator is provided with, on its shaft, a plurality of grooves for retaining rings for determining an arrangement of the retaining rings.

9. The sheet folding device according to claim 1, wherein among the rotator pairs that enhance the fold in the central portion of the sheet, the rotator pair arranged in a most upstream in the sheet conveying direction is configured so that a pressurizing force applied thereto is smaller than a pressurizing force applied to the other rotator pairs of the rotator pairs.

10. The sheet folding device according to claim 1, wherein the rotator pair arranged in a most upstream in the sheet conveying direction is configured so that a pressurizing force applied thereto is smaller than a pressurizing force applied to the other rotator pairs of the rotator pairs provided in the fold-enhancing unit.

11. The sheet folding device according to claim 1, wherein the fold-enhancing unit includes, between the rotator pairs whose sheet holding members are provided at different positions, of the rotator pairs provided in the fold-enhancing unit:

a conveying guide member that is configured so that a fold height direction of the sheet is made narrower in a tapered manner toward a downstream in the sheet conveying direction, and a minimum conveying space controls the fold height of the sheet; and a conveying roller pair that is provided in the conveying guide member and has a pressurizing force and a surface roughness smaller than those of the rotator pairs.

12. An image forming apparatus comprising a sheet folding device according to claim 1.

* * * * *